US008596995B2

(12) United States Patent
Yuasa et al.

(10) Patent No.: US 8,596,995 B2
(45) Date of Patent: Dec. 3, 2013

(54) SEALING STRUCTURE AND COMPRESSOR

(75) Inventors: Kenichi Yuasa, Kusatsu (JP); Hiroki Kamiishida, Kusatsu (JP); Takehiro Kanayama, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 724 days.

(21) Appl. No.: 12/745,180

(22) PCT Filed: Nov. 7, 2008

(86) PCT No.: PCT/JP2008/070277

§ 371 (c)(1),
(2), (4) Date: May 27, 2010

(87) PCT Pub. No.: WO2009/069446

PCT Pub. Date: Jun. 4, 2009

(65) Prior Publication Data

US 2010/0310388 A1 Dec. 9, 2010

(30) Foreign Application Priority Data

Nov. 28, 2007 (JP) ..... 2007-306931

(51) Int. Cl.
*F04B 49/00* (2006.01)

(52) U.S. Cl.
USPC ..... 417/312; 417/410.3; 181/403

(58) Field of Classification Search
None
See application file for complete search history.

(56) References Cited

U.S. PATENT DOCUMENTS 3,193,193 A * 7/1965 Gerteis ..... 417/312
2009/0232679 A1 9/2009 Yanagisawa et al.

FOREIGN PATENT DOCUMENTS

JP 02-215993 A 8/1990
JP 2006-177223 A 7/2006
JP 2006177223 A * 7/2006
JP 2007-270679 A 10/2007
WO WO-2007/069564 A1 6/2007

OTHER PUBLICATIONS

International Preliminary Report of corresponding PCT Application No. PCT/JP2008/070277.

* cited by examiner

*Primary Examiner* — Charles Freay
*Assistant Examiner* — Patrick Hamo
(74) *Attorney, Agent, or Firm* — Global IP Counselors

(57) ABSTRACT

A sealing is arranged between a rear head having an ejection port configured and arranged to eject compressed refrigerant and a rear muffler disposed so that a muffler space is formed between the rear muffler and the rear head. The rear head includes a main body having a bearing hole, an annular boss portion protruding from the main body and circumscribing the bearing hole, and an annular side wall protruding from the main body and circumscribing the boss portion. The rear muffler has an opening and is fastened to the end surface of the side wall so that the peripheral portion of the opening contacts the end surface of the boss portion. Preferably, the end surface of the boss portion has a part entirely further from the main body than the end surface of the side wall.

20 Claims, 11 Drawing Sheets

SEALING STRUCTURE AND COMPRESSOR

CROSS-REFERENCE TO RELATED APPLICATIONS

This U.S. National stage application claims priority under 35 U.S.C. §119(a) to Japanese Patent Application No. 2007-306931, filed in Japan on Nov. 28, 2007, the entire contents of which are hereby incorporated herein by reference.

TECHNICAL FIELD

The present invention relates to a sealing structure between a head component having an ejection port ejecting compressed refrigerant and a muffler component which is provided so that a muffler space is formed between the head component and the muffler component, and also relates to a compressor having the sealing structure.

BACKGROUND ART

A typical rotary compressor includes a cylinder, a roller which rotates in a cylinder chamber of the cylinder, a head component having an ejection port by which refrigerant compressed by the rotation of the roller is ejected, and a muffler component which is provided so that a muffler space is formed between the head component and the muffler component. FIG. 14 schematically illustrates a sealing structure between a head component and a muffler component according to a conventional example. As shown in FIG. 14(*a*), a conventional sealing structure 650 between a head component and a muffler component is arranged so that the muffler component 639 is fastened to a side wall 638*d* of the head component 638 by plural bolts 642, and a muffler space is formed by blocking off a recess 638A formed in the head component 638.

However, the conventional sealing structure 650 of FIG. 14(*a*) is disadvantageous in that, when a mounting surface of the muffler component 639 and a mounting surface of the head component 638 are not flat enough, a gap is formed between a boss portion 638*c* of the head component 638 and the muffler component 639 as shown in FIG. 14(*b*), and refrigerant leaks out from the gap.

In consideration of the above, recent developed arrangements prevent the leakage of refrigerant through the gap by preventing the formation of the gap between the boss portion and the muffler component in such a way that the precision of the mounting surfaces of the muffler component and the head component is improved by machining.

However, even if the mounting surfaces of the muffler component and the head component have been subjected to machining, as shown in FIG. 14(*c*), refrigerant introduced through an ejection port (not illustrated) of the head component 638 causes a pressure P1 of the muffler space to be higher than a pressure P2 in the closed container of the compressor, with the result that the refrigerant leaks out from the border between the boss portion 638*c* and the muffler component 639, which part is not fastened by the bolts 642. The leakage of refrigerant induces increase in vibration and noise of the compressor and obstructs lubricating oil from being supplied to a slide portion because the lubricating oil stored in the bottom portion of the closed container foams, and hence the reliability of the compressor is deteriorated.

To solve this problem, various structures have been proposed to prevent refrigerant from leaking from the border between the boss portion and the muffler component (see e.g. Japanese Unexamined Patent Publication No. 215993/1990).

A rotary compressor disclosed in Japanese Unexamined Patent Publication No. 215993/1990 is arranged so that the leakage of refrigerant from the border between the boss portion and the muffler component is prevented by providing a conical claw washer as a gas sealing member between the boss portion and the muffler component.

SUMMARY

The rotary compressor of Japanese Unexamined Patent Publication No. 215993/1990, however, is disadvantageous in that it is necessary to increase the number of components because a conical claw washer is required to secure the sealing performance between the boss portion and the muffler component.

The present invention was done to solve the problem above, and an objective of the present invention is to provide a sealing structure and a compressor, which are capable of securing the sealing performance between the head component and the muffler component without increasing the machining accuracy of the mounting surfaces of the head component and the muffler component and without increasing the number of components.

A sealing structure according to the first aspect of the invention is between a head component having an ejection port ejecting compressed refrigerant and a muffler component which is disposed so that a muffler space is formed between the muffler component and the head component, wherein, the head component includes: a main body having a bearing hole into which an axial member is inserted; an annular boss portion protruding from the main body while circumscribing the bearing hole; and an annular side wall protruding from the main body while circumscribing the boss portion, and wherein, the muffler component has an opening into which the axial member is inserted and the muffler component is fastened to an end surface of the side wall so that a peripheral portion of the opening contacts an end surface of the boss portion, and wherein, the end surface of the boss portion has a part which is entirely further from the main body than the end surface of the side wall.

In this sealing structure, since the end surface of the boss portion is further from the main body than the plane including the end surface of the side wall, the contact force of the peripheral portion of the opening of the muffler component onto the end surface of the boss portion is high, with the result that the sealing performance between the peripheral portion of the muffler component and the boss portion of the head component is secured. This prevents the formation of a gap between the peripheral portion of the muffler component and the boss portion of the head component, thereby preventing refrigerant from leaking from the gap. Consequently, in a compressor having the sealing structure above, problems such as vibration and noise of the compressor and the foaming of the lubricating oil caused by leaked refrigerant are restrained, and hence the deterioration of the reliability of the compressor is restrained.

In addition to the above, the sealing structure can secure the sealing performance between the peripheral portion of the muffler component and the boss portion of the head component by the aforesaid contact force, even if the mounting surface of the head component and the mounting surface of the muffler component are not precisely processed by machining. Since the process of machining of the head component and the muffler component is unnecessary, cost increase associated with the machining does not occur.

In addition to the above, since the sealing structure secures the sealing performance between the peripheral portion of the muffler component and the boss portion of the head component by the boss portion of the head component, an additional component for improving the sealing performance of that part is unnecessary, and hence the productivity is improved.

In the second aspect of the invention, the sealing structure according to the first aspect of the invention is further arranged so that the end surface of the boss portion is entirely further from the main body than the plane including the end surface of the side wall.

In this sealing structure, the entirety of the end surface of the boss portion contacting the peripheral portion of the opening of the muffler component is further from the main body than the plane including the end surface of the side wall, and hence the sealing performance between the peripheral portion of the muffler component and the boss portion of the head component is further improved.

In the third aspect of the invention, the sealing structure according to the first or second aspect is further arranged so that the end surface of the boss portion is arranged to taper radially inward.

In this sealing structure, the end surface of the boss portion can be arranged to taper in accordance with the shape of the peripheral portion of the muffler component, which flexes and deforms due to the contact with the boss portion. As a result, the peripheral portion of the muffler component surface-contacts the boss portion of the head component, and hence the sealing performance between the peripheral portion of the muffler component and the boss portion of the head component is further improved.

In addition to the above, in this sealing structure, since the direction of the force exerted from the muffler component to the end surface of the boss portion is oblique to the axial direction of the boss portion, it is possible to restrain the distortion of the head component.

In the fourth aspect of the invention, the sealing structure according to any one of the first to third aspects is further arranged so that, on a fastening plane of the muffler component before the muffler component is fastened to the head component, the peripheral portion of the opening is arranged to protrude from a part of the fastening plane which part contacts the end surface of the side wall.

In this sealing structure, the protruding peripheral portion contacts the above-described boss portion. Therefore the contact force of the peripheral portion onto the end surface of the boss portion is further enhanced, and hence the sealing performance between the peripheral portion of the muffler component and the boss portion of the head component is further improved.

In the fifth aspect of the invention, the sealing structure according to any one of the first to third aspects is further arrangement so that, the muffler component is made of a ferrous material, the head component has plural fastening holes penetrating the side wall, and the boss portion and the side wall are arranged so that a value P calculated from a relation $P=(t^3 \times L1)/(\alpha \times a^2)$ is 0.02 square millimeters or lower, where, t is a thickness of the muffler component, L1 is a level difference between the boss portion and the side wall in the head component, a is a distance between an axial center of the head component and a part of an inner periphery of one of the fastening holes of the side wall which part is closest to the axial center of the head component, b is a distance between the axial center of the head component and an outer periphery of the boss portion, and $\alpha$ is a flexibility factor with respect to a diameter ratio b/a.

The inventors of the present invention have found that a load sufficient to distort the head component is not applied to the boss portion and the distortion of the head component is restrained when the value P represented by the relation above is 0.02 square millimeters or lower. Furthermore, the inventors have also found that, when the sealing structure above is used in a compressor, the occurrence of locking in the compressor due to the distortion of the head component is restrained.

A sealing structure of the sixth aspect of the invention is between a head component having an ejection port ejecting compressed refrigerant and a muffler component which is disposed so that a muffler space is formed between the muffler component and the head component, wherein, the head component includes: a main body having a bearing hole into which an axial member is inserted; an annular boss portion protruding from the main body while circumscribing the bearing hole; and an annular side wall protruding from the main body while circumscribing the boss portion, and wherein, the muffler component has an opening into which the axial member is inserted and the muffler component is fastened to an end surface of the side wall so that a peripheral portion of the opening contacts an end surface of the boss portion, and wherein, on a fastening plane of the muffler component before the muffler component is fastened to the head component, the peripheral portion is arranged to protrude from a part of the fastening plane which part contacts the end surface of the side wall.

In this sealing structure, since the peripheral portion of the muffler component protrudes from the part contacting the end surface of the side wall, the contact force of the peripheral portion of the opening of the muffler component onto the end surface of the boss portion is high, with the result that the sealing performance between the peripheral portion of the muffler component and the boss portion of the head component is secured. This prevents the formation of a gap between the peripheral portion of the muffler component and the boss portion of the head component, thereby preventing refrigerant from leaking from the gap. Consequently, in a compressor having the sealing structure above, problems such as vibration and noise of the compressor and the foaming of the lubricating oil caused by leaked refrigerant are restrained, and hence the deterioration of the reliability of the compressor is restrained.

In addition to the above, the sealing structure can secure the sealing performance between the peripheral portion of the muffler component and the boss portion of the head component by the aforesaid contact force, even if the mounting surface of the head component and the mounting surface of the muffler component are not precisely processed by machining. Since the process of machining of the head component and the muffler component is unnecessary, cost increase associated with the machining does not occur.

In addition to the above, since the sealing structure secures the sealing performance between the peripheral portion of the muffler component and the boss portion of the head component by the peripheral portion of the muffler component, an additional component for improving the sealing performance of that part is unnecessary, and hence the productivity is improved.

In the seventh aspect of the invention, the sealing structure according to the sixth aspect is further arranged so that the peripheral portion is arranged to taper radially inward.

In this sealing structure, the peripheral portion of the muffler component can be arranged to taper so that the peripheral portion flexing and deforming due to the contact with the boss portion is shaped in accordance with the end surface of the boss portion. As a result, the peripheral portion of the muffler component surface-contacts the boss portion of the head component, and hence the sealing performance between the peripheral portion of the muffler component and the boss portion of the head component is further improved.

In the eighth aspect of the invention, the sealing structure according to the sixth or seventh aspect is further arranged so that the end surface of the boss portion and the end surface of the side wall are on a single plane.

In the ninth aspect of the invention, the sealing structure according to the sixth or seventh aspect is further arranged so that the end surface of the boss portion has a part which is entirely further from the main body than a plane including the end surface of the side wall.

In this sealing structure, the protruding peripheral portion contacts the boss portion having the end surface which is further from the main body than the plane including the end surface of the side wall. Therefore the contact force of the peripheral portion onto the end surface of the boss portion is further enhanced, and hence the sealing performance between the peripheral portion of the muffler component and the boss portion of the head component is further improved.

In the tenth aspect of the invention, the sealing structure according to the ninth aspect is further arrangement so that the end surface of the boss portion is entirely further from the main body than the plane including the end surface of the side wall.

In this sealing structure, since the entirety of the end surface of the boss portion contacting the peripheral portion of the opening of the muffler component is further from the main body than the end surface of the side wall, the sealing performance between the peripheral portion of the muffler component and the boss portion of the head component is further improved.

In the eleventh aspect of the invention, the sealing structure according to any one of the sixth to eighth aspects is further arranged so that the muffler component is made of a ferrous material, the head component has plural fastening holes penetrating the side wall, and the boss portion and the side wall are arranged so that a value P calculated from a relation $P=(t^3\times L2)/(\alpha\times a^2)$ is 0.02 square millimeters or lower, where, t is a thickness of the muffler component, L2 is a level difference between a peripheral portion of the muffler component and a part of the muffler component which part contacts the end surface of the side wall of the head component, a is a distance between an axial center of the head component and a part of an inner periphery of one of the fastening holes of the side wall which part is closest to the axial center of the head component, b is a distance between the axial center of the head component and an outer periphery of the boss portion, and $\alpha$ is a flexibility factor with respect to a diameter ratio b/a.

The inventors of the present invention have found that a load sufficient to distort the head component is not applied to the boss portion and the distortion of the head component is restrained when the value P represented by the relation above is 0.02 square millimeters or lower. Furthermore, the inventors have also found that, when the sealing structure above is used in a compressor, the occurrence of locking in the compressor due to the distortion of the head component (boss portion) is restrained.

In the twelfth aspect of the invention, the sealing structure according to any one of the fourth, ninth, and tenth aspects is further arranged so that, the muffler component is made of a ferrous material, the head component has plural fastening holes penetrating the side wall, and the boss portion and the side wall are arranged on that a value P calculated from a relation $P=(t^3\times(L1-L2))/(\alpha\times a^2)$ is 0.02 square millimeters or lower, where, t is a thickness of the muffler component, L1 is a level difference between the boss portion and the side wall in the head component, L2 is a level difference between a peripheral portion of the muffler component and a part of the muffler component which part contacts the end surface of the side wall of the head component, a is a distance between an axial center of the head component and a part of an inner periphery of one of the fastening holes of the side wall which part is closest to the axial center of the head component, b is a distance between the axial center of the head component and an outer periphery of the boss portion, and $\alpha$ is a flexibility factor with respect to a diameter ratio b/a.

The inventors of the present invention have found that a load sufficient to distort the head component is not applied to the boss portion and the distortion of the head component is restrained when the value P represented by the relation above is 0.02 square millimeters or lower. Furthermore, the inventors have also found that, when the sealing structure above is used in a compressor, the occurrence of locking in the compressor due to the distortion of the head component (boss portion) is restrained.

In the thirteenth aspect of the invention, the sealing structure according to any one of the first to twelfth aspects is further arranged so that the head component has an annular bearing portion which protrudes from the boss portion while circumscribing the bearing hole in the boss portion.

In this sealing structure, the bearing length of the axial member is long.

In the fourteenth aspect of the invention, the sealing structure according to any one of the first to thirteenth aspects is further arranged so that the head component is formed by sintering.

This sealing structure can be formed by sintering because it is unnecessary to precisely process the head component by machining, and hence the productivity is improved.

A compressor according to the fifteenth aspect of the invention includes the sealing structure according to any one of the first to fourteenth aspects.

As described above, this compressor makes it possible to secure the sealing performance between the head component and the muffler component without precisely processing the mounting surfaces of the head component and the muffler component and without increasing the number of components.

As described above, the present invention achieves the following effects.

According to the first and second aspects of the invention, the contact force of the peripheral portion of the opening of the muffler component onto the end surface of the boss portion is high, with the result that the sealing performance between the peripheral portion of the muffler component and the boss portion of the head component is secured. Consequently, in a compressor having the sealing structure above, problems such as vibration and noise of the compressor and the foaming of the lubricating oil caused by leaked refrigerant are restrained, and hence the deterioration of the reliability of the compressor is restrained. Furthermore, since the process of machining of the mounting surface of the head component and the mounting surface of the muffler component is unnecessary, cost increase associated with the machining does not occur. Furthermore, an additional component for improving the sealing performance of that part is unnecessary, and hence the productivity is improved.

According to the third aspect of the invention, the peripheral portion of the muffler component surface-contacts the boss portion of the head component, and hence the sealing performance between the peripheral portion of the muffler component and the boss portion of the head component is further improved. Furthermore, since the direction of the force exerted from the muffler component to the end surface of the boss portion is oblique to the axial direction of the boss portion, it is possible to restrain the distortion of the head component.

According to the fourth aspect of the invention, the protruding peripheral portion contacts the above-described boss portion. Therefore the contact force of the peripheral portion onto the end surface of the boss portion is further enhanced, and hence the sealing performance between the peripheral portion of the muffler component and the boss portion of the head component is further improved.

According to the fifth, eleventh, and twelfth aspects of the invention, when the sealing structure above is used in a compressor, the occurrence of locking in the compressor due to the distortion of the head component (boss portion) is restrained.

According to the sixth, ninth, and tenth aspects of the invention, the contact force of the peripheral portion of the muffler component onto the end surface of the boss portion is high, with the result that the sealing performance between the peripheral portion of the muffler component and the boss portion of the head component is secured. Consequently, in a compressor having the sealing structure above, problems such as vibration and noise of the compressor and the foaming of the lubricating oil caused by leaked refrigerant are restrained, and hence the deterioration of the reliability of the compressor is restrained. Furthermore, since the process of machining of the mounting surface of the head component and the mounting surface of the muffler component is unnecessary, cost increase associated with the machining does not occur. Furthermore, an additional component for improving the sealing performance of that part is unnecessary, and hence the productivity is improved.

According to the seventh aspect of the invention, the peripheral portion of the muffler component surface-contacts the boss portion of the head component, and hence the sealing performance between the peripheral portion of the muffler component and the boss portion of the head component is further improved. Furthermore, since the direction of the force exerted from the muffler component to the end surface of the boss portion is oblique to the axial direction of the boss portion, it is possible to restrain the distortion of the head component.

According to the thirteenth aspect of the invention, the bearing length of the axial member is long.

According to the fourteenth aspect of the invention, the sealing structure can be formed by sintering because it is unnecessary to precisely process the head component by machining, and hence the productivity is improved.

According to the fifteenth aspect of the invention, it is possible to secure the sealing performance between the head component and the muffler component without precisely processing the mounting surfaces of the head component and the muffler component and without increasing the number of components.

BRIEF DESCRIPTION OF THE DRAWINGS

FIG. 7 is a graph showing a flexibility factor $\alpha$ with respect to a diameter ratio b/a.

DETAILED DESCRIPTION OF EMBODIMENT(S)

The following will describe an embodiment of a compressor having a sealing structure of the present invention with reference to figures.

First Embodiment

Figure 1:
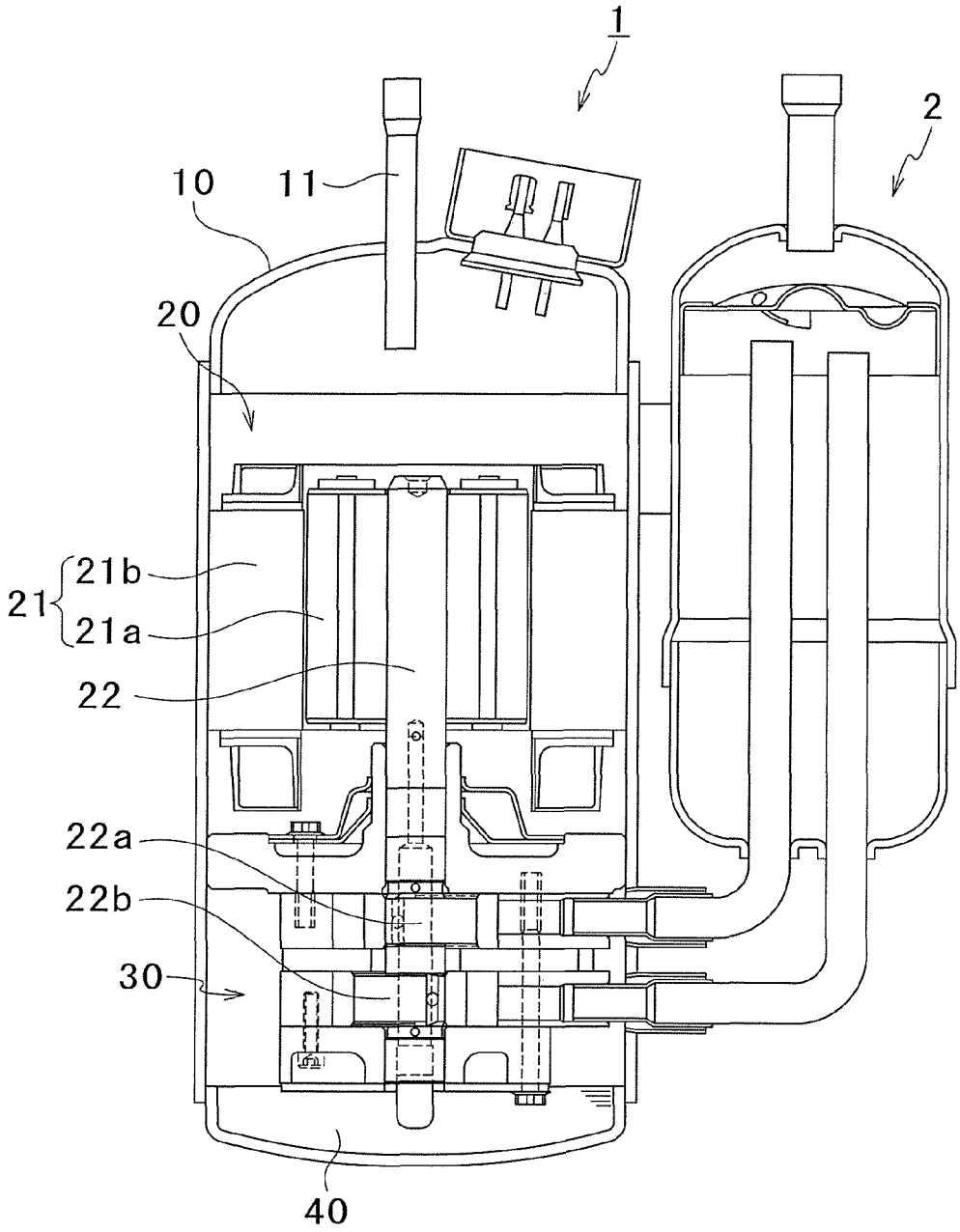
FIG. 1 is a cross section of a rotary compressor and an accumulator of First Embodiment according to present invention.
Figure 2:
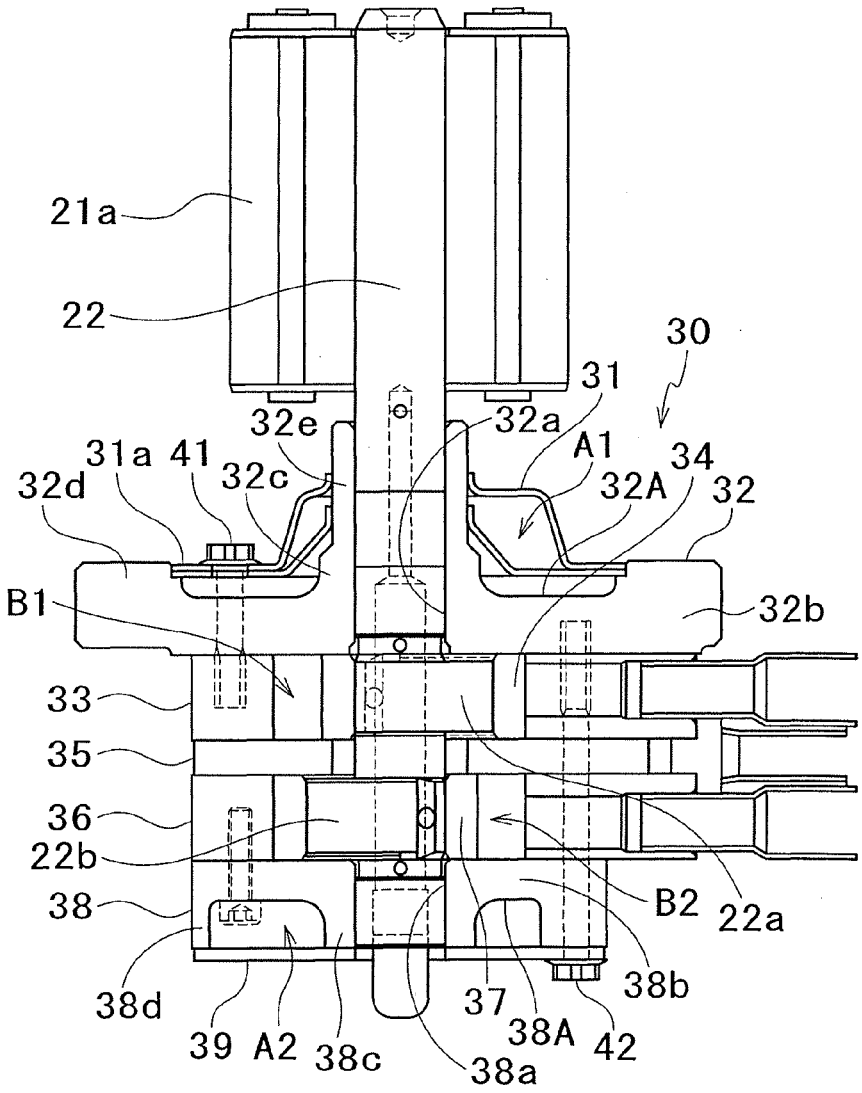
FIG. 2 is a cross section of the drive mechanism and the compression mechanism of the rotary compressor of FIG. 1.
Figure 3:
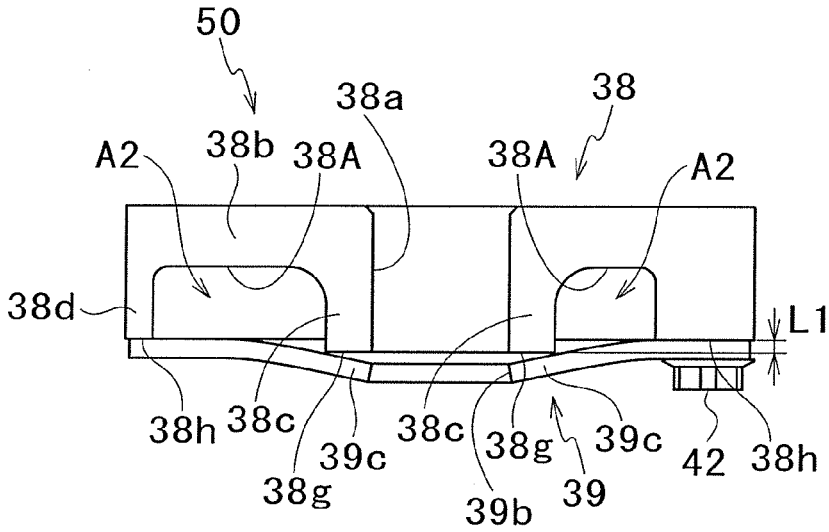
FIG. 3 schematically shows a sealing structure.
Figure 4:
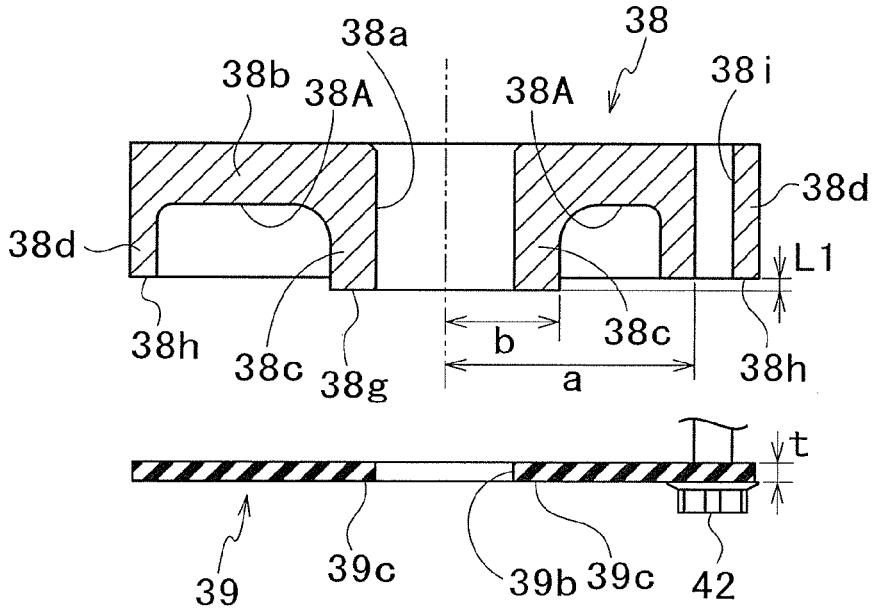
FIG. 4 schematically shows a rear head and a rear muffler before fastened.
Figure 5:
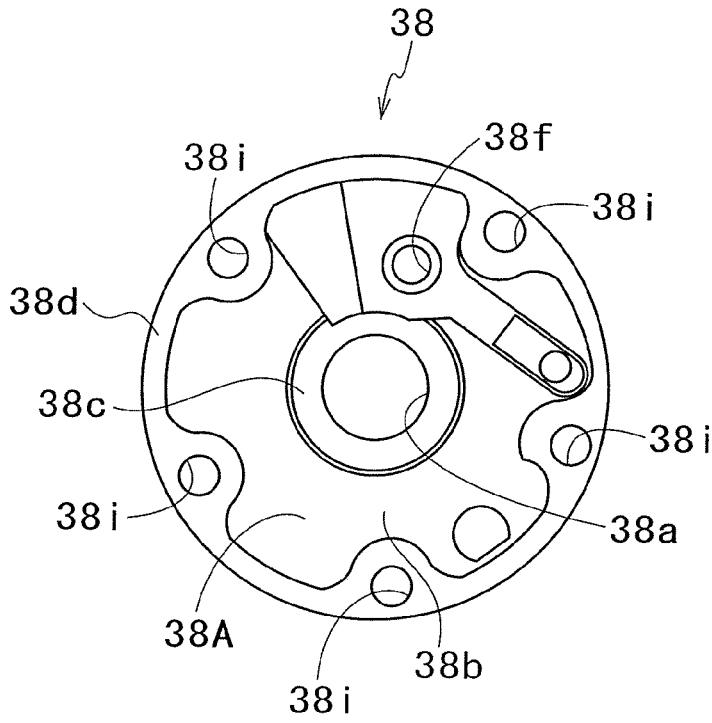
FIG. 5 is a plan view of the rear head.
Figure 6:
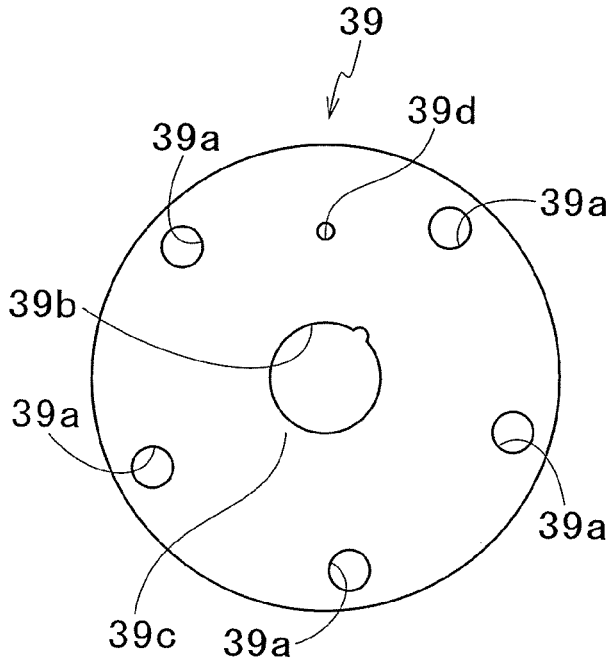
FIG. 6 is a plan view of the rear muffler.

FIG. 1 is a cross section of a rotary compressor and an accumulator of First Embodiment according to present invention. FIG. 2 is a cross section of the drive mechanism and the compression mechanism of the rotary compressor of FIG. 1. FIG. 3 schematically shows a sealing structure. FIG. 4 schematically shows a rear head and a rear muffler before fastened. FIG. 5 is a plan view of the rear head. FIG. 6 is a plan view of the rear muffler. Referring to FIGS. 1 to 6, details of a rotary compressor 1 of First Embodiment will be given.

As shown in FIG. 1 and FIG. 2, the rotary compressor 1 includes a closed casing 10 and this closed casing 10 houses therein a drive mechanism 20 and a compression mechanism 30. This rotary compressor 1 is a so-called high-pressure dome type compressor, and the compression mechanism 30 is disposed below the drive mechanism 20 in the closed casing 10. In the lower part of the closed casing 10 is stored lubricating oil 40 supplied to each slide portion of the compression mechanism 30.

The drive mechanism 20 is provided to drive the compression mechanism 30 and includes a motor 21 as a drive source and a shaft 22 attached to the motor 21.

The motor 21 includes a rotor 21*a* and a stator 21*b* which is provided radially outside the rotor 21*a* with an air gap therebetween. This rotor 21*a* has a rotatable shaft 22. The rotor 21*a* further has a rotor main body made of laminated magnetic steel sheets and a magnet embedded in the rotor main body. The stator 21*b* includes a stator main body made of steel and a coil wound around the stator main body. The motor 21 rotates the rotor 21*a* along with the shaft 22 by an electromagnetic power which is generated on the stator 21*b* in response to a current supply to the coil.

As the shaft 22 rotates along with the rotor 21*a*, rollers 34 and 37 of the compression mechanism 30 are rotated. The shaft 22 is provided with an eccentric portion 22*a* to be positioned in a cylinder chamber B1 of a later-described front cylinder 33, and is also provided with an eccentric portion 22*b* to be positioned in a cylinder chamber B2 of a rear cylinder 36. These eccentric portions 22*a* and 22*b* are provided with the rollers 34 and 37, respectively. Therefore, in response to the rotation of the shaft 22, the roller 34 attached to the eccentric portion 22*a* rotates in the cylinder chamber B1 and the roller 37 attached to the eccentric portion 22*b* rotates in the cylinder chamber B2. The eccentric portion 22*a* and the eccentric portion 22*b* deviate from each other by 180 degrees, in the direction of rotation of the shaft 22.

On the other hand, the compression mechanism 30 is provided to compress and discharge refrigerant sucked from the accumulator 2. The refrigerant discharged from the compression mechanism 30 passes through the air gap between the stator 21*b* and the rotor 21*a* of the drive mechanism 20, cools the drive mechanism 20, and is then discharged from a discharge pipe 11. This compression mechanism 30 has, from the top to the bottom along the rotational axis of the shaft 22 of the drive mechanism 20, a front muffler 31, a front head 32, a front cylinder 33 and a roller 34, a middle plate 35, a rear cylinder 36 and a roller 37, a rear head 38, and a rear muffler 39.

The front muffler 31 forms a muffler space A1 with the front head 32 in order to reduce the noise associated with the discharge of refrigerant. This front muffler 31 is hat-shaped and attached to block off a recess 32A of the front head 32. A bolt 41 by which the front muffler 31 is fixed is screwed into a screw hole of the front cylinder 33 via a through hole of a flange portion 31*a* of the front muffler 31 and a through hole of the front head 32.

The front head 32 is provided above the front cylinder 33 to block off the upper opening of the cylinder chamber B1 of the front cylinder 33. This front head 32 includes a disc-shaped main body 32*b* having a bearing hole 32*a* into which the shaft 22 is inserted, an annular boss portion 32*c* which protrudes upward from the main body 32*b* while circumscribing the bearing hole 32*a*, an annular side wall 32*d* which protrudes upward from the main body 32*b* while circumscribing the boss portion 32*c*, and an annular bearing portion 32*e* which protrudes upward from the boss portion 32*c* while circumscribing the bearing hole 32*a* in the boss portion 32*c*. The main body 32*b* is provided with an ejection port (not illustrated) which discharges refrigerant compressed by the rotation of the roller 34 in the cylinder chamber B1 of the front cylinder 33. The refrigerant discharged from the ejection port is discharged through a discharge hole (not illustrated) formed in the front muffler 31, via the aforesaid muffler space A1. The main body 32*b* also has a discharge valve (not illustrated) which opens and closes the outlet of the ejection port.

The front cylinder 33 has the cylinder chamber B1 having the roller 34 which eccentrically moves in response to the rotation of the shaft 22. This cylinder chamber B1 is connected to the muffler space A1 via the above-described unillustrated ejection port. Therefore, the refrigerant compressed by the eccentric movement of the roller 34 attached to the eccentric portion 22*a* of the shaft 22 is introduced from the cylinder chamber B1 into the muffler space A1 via the above-described ejection port.

The middle plate 35 is provided between the front cylinder 33 and the rear cylinder 36. This middle plate 35 blocks off the lower opening of the cylinder chamber B1 of the front cylinder 33 and also blocks off the upper opening of the cylinder chamber B2 of the rear cylinder 36.

The rear cylinder 36 is provided with the cylinder chamber B2 having the roller 37 which eccentrically moves in response to the rotation of the shaft 22. This cylinder chamber B2 is connected to the muffler space A2 via a later-described ejection port 38*f* (see FIG. 5). Therefore, the refrigerant compressed by the eccentric movement of the roller 37 attached to the eccentric portion 22*b* of the shaft 22 is introduced from the cylinder chamber B2 to the muffler space A2 via the ejection port 38*f*.

The rear head 38 is provided below the rear cylinder 36 to block off the lower opening of the cylinder chamber B2 of the rear cylinder 36. As shown in FIG. 2 to FIG. 5, this rear head 38 includes a disc-shaped main body 38*b* having a bearing hole 38*a* into which the shaft 22 is inserted, an annular boss portion 38*c* which protrudes downward from the main body 38*b* while circumscribing the bearing hole 38*a*, and an annular side wall 38*d* which protrudes downward from the main body 38*b* while circumscribing the boss portion 38*c*. The main body 38*b* has an ejection port 38*f* (see FIG. 5) which discharges refrigerant compressed by the rotation of the roller 37 in the cylinder chamber B2 of the rear cylinder 36. The refrigerant discharged from the ejection port 38*f* is discharged through a discharge hole 39*d* (see FIG. 6) formed in the rear muffler 39, via a later-described muffler space A2. The main body 38*b* is also provided with a discharge valve (not illustrated) by which the outlet of the ejection port 38*f* is opened and closed. In the present embodiment, as shown in FIG. 3 and FIG. 4, the entirety of the end surface 38*g* of the boss portion 38*c* is below the plane including the end surface 38*h* of the side wall 38*d*, i.e. is further from the main body 38*b* than the plane including the end surface 38*h*. The side wall 38*d* has plural (five in the present embodiment) fastening holes 38*i* which allow the bolts 42 to penetrate therethrough, as shown in FIG. 5. The rear head 38 is formed by sintering.

In the present embodiment, furthermore, the boss portion 38*c* and the side wall 38*d* are arranged so that the value P represented by the following relation (1) is 0.02 square millimeters or lower.

$$\text{relation: } P=(t^3\times L1)/(\alpha\times a^2) \quad (1)$$

where, t: thickness of rear muffler 39 (mm)

L1: level difference (mm) between boss portion 38*c* and side wall 38*d* in rear head 38 a: distance (mm) between axial center of rear head 38 and a part of inner periphery of fastening hole 38*i* of side wall 38*d* which part is closest to axial center of rear head 38 b: distance (mm) between axial center of rear head 38 and outer periphery of boss portion 38*c*

α: flexibility factor with respect to diameter ratio b/a

The relation (1) above derives from an equation (A) which is disclosed "Mechanical Engineers' Handbook, Fundamentals, A4, Materials and Mechanics", The Japan Society of Mechanical Engineers, Jun. 25, 1984, p 55, No. 10 and indicates a flexible volume w when a circle-shaped load is applied to the inner circumference of an annular disc while the outer circumference thereof is fixed.

$$w=(\alpha'\times P'\times a'^2)/(E'\times t'^3) \quad (A)$$

where, a': flexibility factor

P': supporting load applied to inner periphery

Figure 7:
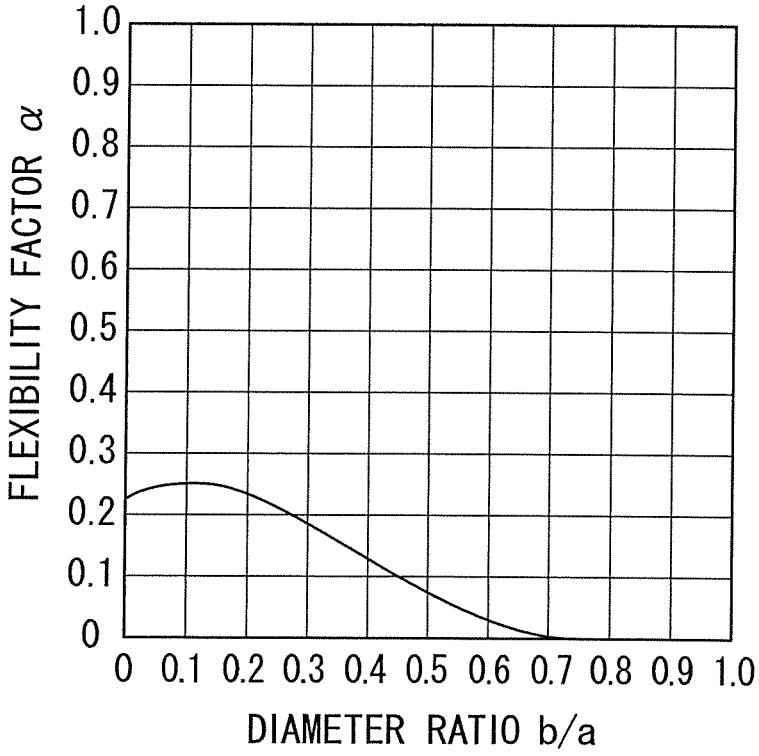

E': Young's modulus of material of annular disc t': thickness of annular disc a': distance between center and fixed part of outer circumference Regarding the relation (1), the thickness t of the rear muffler 39, the level difference L1 between the boss portion 38*c* and the side wall 38*d* in the rear head 38, the distance a between the axial center of the rear head 38 and a part of the inner periphery of the fastening hole 38*i* of the side wall 38*d* which part is closest to the axial center of the rear head 38, and the distance b between the axial center of the rear head 38 and the outer periphery of the boss portion 38*c* are arranged as shown in FIG. 3 and FIG. 4. The flexibility factor α with respect to the diameter ratio b/a is determined in accordance with the ratio of the distance a to the distance b, and is determined by the graph in FIG. 7 in the same manner as the flexibility factor α' in the equation (A). The graph is disclosed in "Mechanical Engineers' Handbook, Fundamentals, A4, Materials and Mechanics", The Japan Society of Mechanical Engineers, Jun. 25, 1984, p 58, FIG. 83.

The rear muffler 39 forms the muffler space A2 with the rear head 38 in order to reduce the noise associated with the discharge of refrigerant. This rear muffler 39 has a substantially flat shape and is attached to block off a recess 38A of the rear head 38. This rear muffler 39 has, as shown in FIG. 6, five through holes 39*a* formed to positionally correspond to the above-described five fastening holes 38*i* (see FIG. 5) of the rear head 38, an opening 39*b* into which the shaft 22 is inserted, a peripheral portion 39*c* around the opening 39*b*, and a discharge hole 39*d* through which compressed refrigerant is discharged from the muffler space A2. The rear muffler 39 is made of a ferrous material.

The above-described sealing structure 50 between the rear head 38 and the rear muffler 39 is formed in such a way that the rear muffler 39 is attached to the rear head 38. More specifically, five bolts 42 are screwed into the screw holes of the front cylinder 33 via the five through holes 39*a* made through the rear muffler 39, the five fastening holes 38*i* made through the rear head 38, and the five through holes made through the middle plate 35, so that the rear muffler 39 is fixed to the rear head 38. As a result, the peripheral portion 39*c* of the opening 39*b* of the rear muffler 39 contacts the end surface 38*g* of the boss portion 38*c* of the rear head 38. In this regard, since the end surface 38*g* of the boss portion 38*c* is below the plane including the end surface 38*h* of the side wall 38*d*, the substantially flat rear muffler 39 flexes as the peripheral portion 39*c* thereof contacts the end surface 38*g* of the boss portion 38*c*. By this flexing force of the peripheral portion 39*c*, the boss portion 38*c* of the rear head 38 tightly contacts the peripheral portion 39*c* of the rear muffler 39.

[Characteristics of Sealing Structure of First Embodiment]

The sealing structure 50 of First Embodiment has the following characteristics.

In the sealing structure 50 of the present embodiment, as the end surface 38*g* is further from the main body 38*b* than the plane including the end surface 38*h* of the side wall 38*d*, the contact force of the peripheral portion 39*c* of the opening 39*b* of the rear muffler 39 onto the end surface 38*g* of the boss portion 38*c* is high, with the result that the sealing performance between the peripheral portion 39*c* of the rear muffler 39 and the boss portion 38*c* of the rear head 38 is secured. This prevents the formation of a gap between the peripheral portion 39*c* of the rear muffler 39 and the boss portion 38*c* of the rear head 38, thereby preventing refrigerant from leaking from the gap. Consequently, in the rotary compressor 1 having the sealing structure 50 above, problems such as vibration and noise of the rotary compressor 1 and the foaming of the lubricating oil 40 caused by leaked refrigerant are restrained, and hence the deterioration of the reliability of the rotary compressor 1 is restrained.

In addition to the above, the sealing structure 50 can secure the sealing performance between the peripheral portion 39*c* of the rear muffler 39 and the boss portion 38*c* of the rear head 38 by the aforesaid flexing force, even if the mounting surface of the rear head 38 and the mounting surface of the rear muffler 39 are not precisely processed by machining. Since the process of machining of the rear head 38 and the rear muffler 39 is unnecessary, cost increase associated with the machining does not occur.

In addition to the above, since the sealing structure 50 secures the sealing performance between the peripheral portion 39*c* of the rear muffler 39 and the boss portion 38*c* of the rear head 38 by the boss portion 38*c* of the rear head 38, an additional component (e.g. a conical claw washer of Patent Document 1) for improving the sealing performance of that part is unnecessary, and hence the productivity is improved.

In addition to the above, the sealing structure 50 can be formed by sintering because it is unnecessary to precisely process the rear head 38 by machining, and hence the productivity is improved.

Second Embodiment

Figure 8:
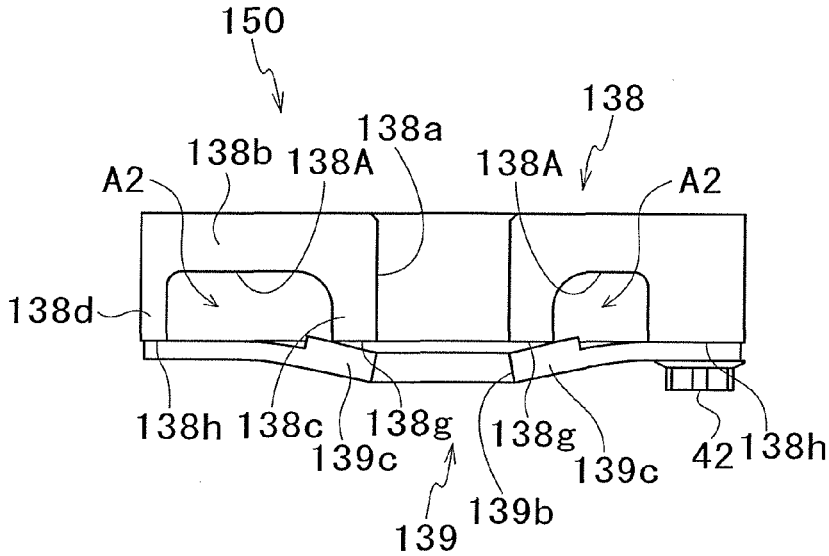
FIG. 8 schematically shows a sealing structure of a rotary compressor of Second Embodiment according to the present invention.
Figure 9:
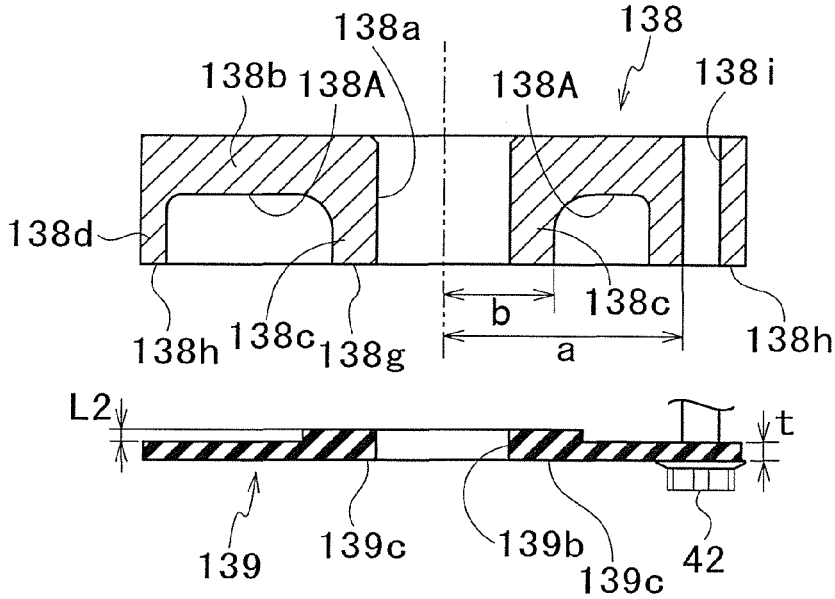
FIG. 9 schematically shows a rear head and a rear muffler before fastened.

FIG. 8 schematically shows a sealing structure of a rotary compressor of Second Embodiment according to the present invention. FIG. 9 schematically shows a rear head and a rear muffler before fastened. Second Embodiment is different from First Embodiment in which the entirety of the end surface of the boss portion of the rear head is arranged to be further from the main body than the plane including the end surface of the side wall. Second Embodiment is arranged so that the peripheral portion of the opening of the rear muffler is shaped to protrude from a part contacting the end surface of the side wall. Since Second Embodiment is identical with First Embodiment except the arrangement of the rear head and the rear muffler, the same reference numerals are assigned to components having substantially identical arrangements as those of First Embodiment, and such components are not detailed again.

A rear head 138 is provided below the rear cylinder 36 to block off the lower opening of the cylinder chamber B2 of the rear cylinder 36. As shown in FIG. 8, this rear head 138 includes: a disc-shaped main body 138*b* having a bearing hole 138*a* into which the shaft 22 is inserted; an annular boss portion 138*c* which protrudes downward from the main body 138*b* while circumscribing the bearing hole 138*a*; and an annular side wall 138*d* which protrudes downward from the main body 138*b* while circumscribing the boss portion 138*c*. The main body 138*b* is provided with an ejection port (not illustrated) which discharges refrigerant compressed by the rotation of the roller 37 in the cylinder chamber 32 of the rear cylinder 36. The refrigerant discharged from the ejection port is discharged through a discharge hole (not illustrated) made through the rear muffler 139, via the muffler space A2. In addition, the main body 138*b* also has a discharge valve (not illustrated) by which the outlet of the ejection port is opened and closed. The end surface 138*g* of the boss portion 138*c* and the end surface 138*h* of the side wall 138*d* which have been described above are on the same plane. The side wall 138*d* further has plural fastening holes 138*i* (see FIG. 9) which allow bolts 42 to penetrate therethrough. The rear head 138 is formed by sintering.

In the present embodiment, the boss portion 138*c* and the side wall 138*d* are arranged so that the value P represented by the relation (2) below is 0.02 square millimeters or lower.

$$\text{relation: } P=(t^3\times L2)/(\alpha\times a^2) \quad (2)$$

where, t: thickness (mm) of rear muffler 139

L2: level difference (mm) between peripheral portion 139*c* of rear muffler 139 and a part of rear muffler 139 which part contacts end surface 138*h* of side wall 138*d* of rear head 138 a: distance (mm) between axial center of rear head 138 and a part of inner periphery of fastening hole 138*i* of side wall 138*d* which part is closest to axial center of rear head 138 b: distance (mm) between axial center of rear head 138 and outer periphery of boss portion 138*c*

α: flexibility factor with respect to diameter ratio b/a

It is noted that the relation (2) also derives from the above-described equation (A).

Regarding the relation (2), the thickness t of the rear muffler 139, the level difference L2 between the peripheral portion 139*c* of the rear muffler 139 and a part of the rear muffler 139 which part contacts the end surface 138*h* of the side wall 138*d* of the rear head 138, the distance a between the axial center of the rear head 138 and a part of the inner periphery of the fastening hole 138*i* of the side wall 138*d* which part is closest to the axial center of the rear head 138, and the distance b between the axial center of the rear head 138 and the outer periphery of the boss portion 138*c* are arranged as shown in FIG. 8 and FIG. 9. The flexibility factor α with respect to the diameter ratio b/a is determined according to the ratio between the aforesaid distances and b, and is determined by the graph in FIG. 7.

The rear muffler 139 forms the muffler space A2 with the rear head 138 in order to reduce noise associated with the discharge of refrigerant. This rear muffler 139 is attached to block off a recess 138A of the rear head 138. The rear muffler 139 has five through holes (not illustrated) positionally corresponding to the fastening holes 138*i* of the rear head 138, an opening 139*b* into which the shaft 22 is inserted, a peripheral portion 139*c* around the opening 139*b*, and a discharge hole (not illustrated) through which compressed refrigerant is discharged from the muffler space A2. In the present embodiment, the peripheral portion 139*c* of the rear muffler 139 before being fastened to rear head 138 is arranged to protrude from a part which contacts the end surface 138*h* of the side wall 138*d* of the rear head 138. The rear muffler 139 is made of a ferrous material.

The above-described sealing structure 150 between the rear head 138 and the rear muffler 139 is formed in such a way that the rear muffler 139 is attached to the rear head 138. More specifically, five bolts 42 are screwed into the screw holes of the front cylinder 33 via the five through holes made through the rear muffler 139, the five fastening holes 138*i* made through the rear head 138, and the five through holes made through the middle plate 35, so that the rear muffler 139 is fixed to the rear head 138. As a result, the peripheral portion 139*c* of the opening 139*b* of the rear muffler 139 contacts the end surface 138*g* of the boss portion 138*c* of the rear head 138. In this regard, since the peripheral portion 139*c* is formed to protrude from the part contacting the end surface 138*h* of the side wall 138*d* of the rear head 138, the rear muffler 139 flexes as the peripheral portion 139*c* thereof contacts the end surface of the boss portion 138*c*. By this flexing force of the peripheral portion 139*c*, the boss portion 138*c* of the rear head 138 tightly contacts the peripheral portion 139*c* of the rear muffler 139.

The effects of the above-described sealing structure 50 of First Embodiment are also attained by the sealing structure 150 of Second Embodiment.

EXAMPLES

Now, an experiment carried out for determining the range of the value P in the relation (1) above will be described. In this experiment, the value P was calculated by the relation above and the occurrence of locking in the rotary compressor was checked, while the thickness (mm) of the rear muffler and the level difference L1 (mm) between the boss portion and the side wall of the rear head were changed. Table 1 shows the result of the experiment. It is noted that the distance a between the axial center of the rear head and a part of the inner periphery of the fastening hole of the side wall which part is closest to the axial center of the rear head was set to 28 mm, the distance b between the axial center of the rear head and the outer periphery of the boss portion was set to 13 mm, and the flexibility factor α with respect to the diameter ratio b/a was set to 0.1.

TABLE 1

| | | LEVEL DIFFERENCE: L1 (mm) | | | | |
|---|---|---|---|---|---|---|
| | | 0.15 | 0.30 | 0.45 | 0.60 | |
| THICKNESS: t (mm) | 1.2 | 0.003 | 0.007 | 0.010 | 0.013 | ⟹ LOCKING DOES NOT OCCUR |
| | 1.6 | 0.008 | 0.016 | 0.024 | 0.031 | |
| | 2.0 | 0.015 | 0.031 | 0.046 | 0.061 | ⟹ LOCKING OCCURS |
| | 2.5 | 0.030 | 0.060 | 0.090 | 0.120 | |
| | 3.2 | 0.063 | 0.125 | 0.188 | 0.251 | |

Table 1 above shows that the rotary compressor can operate without the occurrence of locking, when the value P is not higher than 0.02 square millimeters. This seems because a load sufficient to distort the rear head (boss portion) is not applied to the rear head (boss portion) when the value P is not higher than 0.02 square millimeters and hence the distortion of the rear head is restrained.

While this invention has been described with reference to figures, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

For example, the embodiments above describe the sealing structure between the rear head and the rear muffler which are on the rear side. The present invention is not limited to this arrangement and is applicable to the sealing structure between the front head and the front muffler on the front side.

Also, the embodiments above describe the case where the sealing structure between the rear head and the rear muffler is used for the rotary compressor. The present invention is not limited to this and may be applicable to various compressors such as a scroll compressor.

Figure 10:
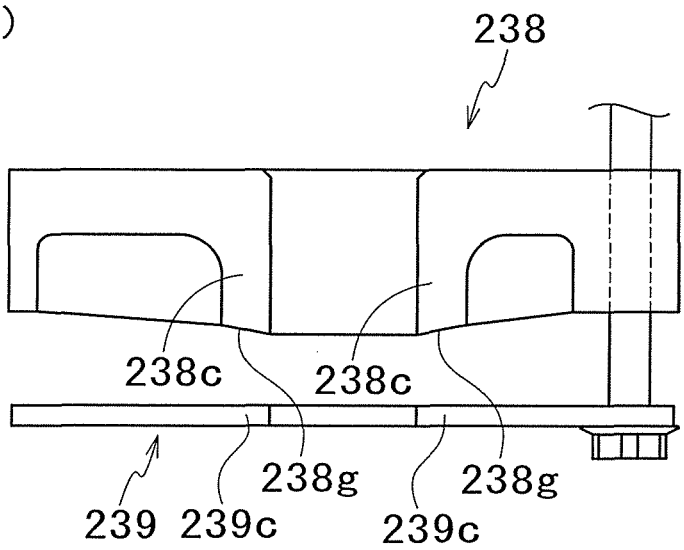
FIG. 10 schematically shows a sealing structure of a variation of First Embodiment.
Figure 10:
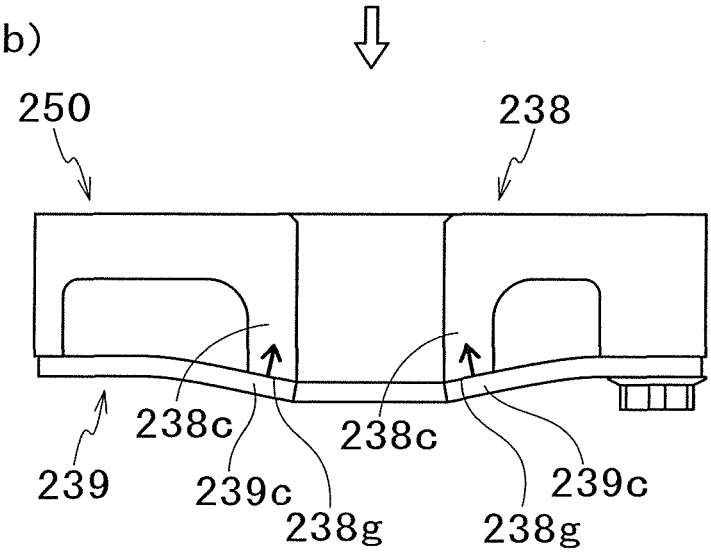

First Embodiment above describes the case where the end surface 38*g* of the boss portion 38*c* of the rear head 38 is a horizontal surface. The present invention is not limited to this arrangement and may be arranged so that, as in the case of a sealing structure 250 of a variation of First Embodiment shown in FIG. 10, an end surface 238*g* of a boss portion 238*c* of a rear head 238 is tapered radially inward. In this case, a peripheral portion 239*c* of a rear muffler 239 surface-contacts the end surface 238*g* of the boss portion 238*c* of the rear head 238, and hence the sealing performance between the peripheral portion 239*c* and the boss portion 238*c* is further improved. Furthermore, since the direction of the force exerted from the rear muffler 239 to the end surface 238*g* of the boss portion 238*c* is oblique to the axial direction of the boss portion 238*c*, the distortion of the rear head 238 is restrained.

Figure 11:
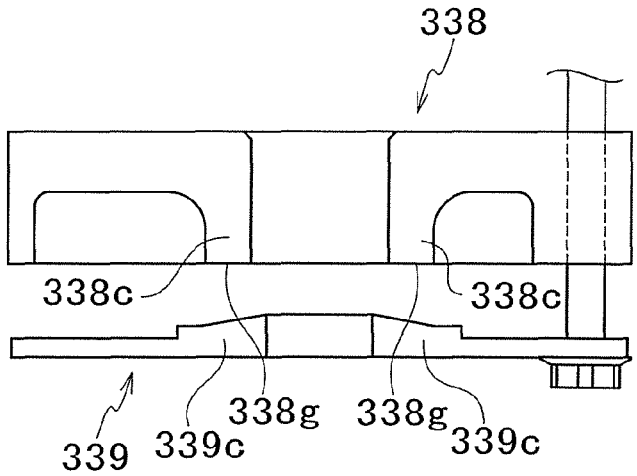
FIG. 11 schematically shows a sealing structure of a variation of Second Embodiment.
Figure 11:
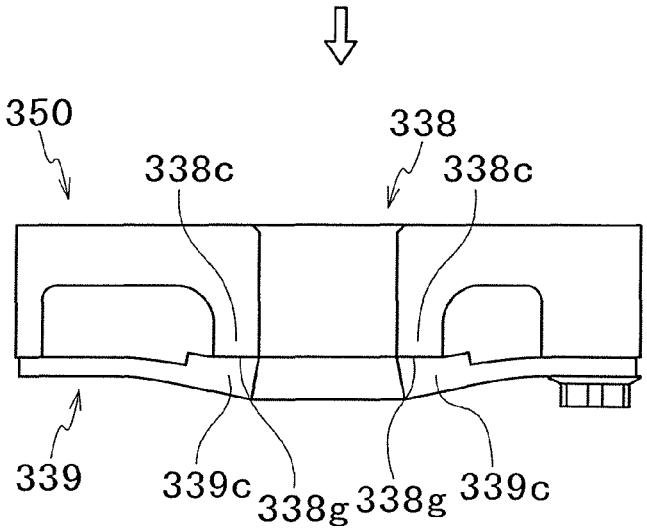

In Second Embodiment above, the protruding peripheral portion 139*c* of the rear muffler 139 is a horizontal surface. The present invention is not limited to this arrangement and may be arranged so that, as in a variation of Second Embodiment show in FIG. 11, a protruding peripheral portion 339*c* of a rear muffler 339 is tapered radially inward. In this case, a peripheral portion 339*c* of a rear muffler 339 surface-contacts a boss portion 338*c* of a rear head 338, and hence the sealing performance between the peripheral portion 339*c* and the boss portion 338*c* is further improved.

Figure 12:
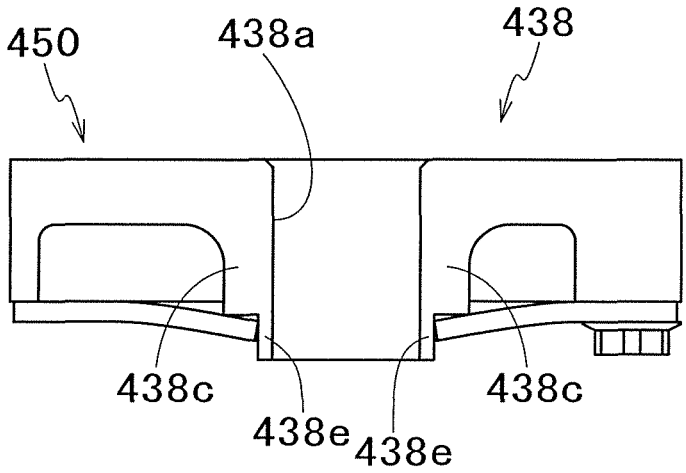
FIG. 12 schematically shows a sealing structure of a variation of First Embodiment.

First Embodiment describes the case where the annular bearing portion 32*e* protruding upward from the boss portion 32*c* is provided so as to circumscribe the bearing hole 32*a* in the boss portion 32*c* of the front head 32. The present invention may be arranged so that, as in a variation of First Embodiment shown in FIG. 12, a rear head 438 is provided with an annular bearing portion 438*e* protruding downward from a boss portion 438*c* so as to circumscribe a bearing hole 438*a* in a boss portion 438*c* of a rear head 438, in the manner similar to the bearing portion 32*e* (see FIG. 2) of the front head 32 of First Embodiment. In this case, the bearing length of the shaft is long.

Figure 13:
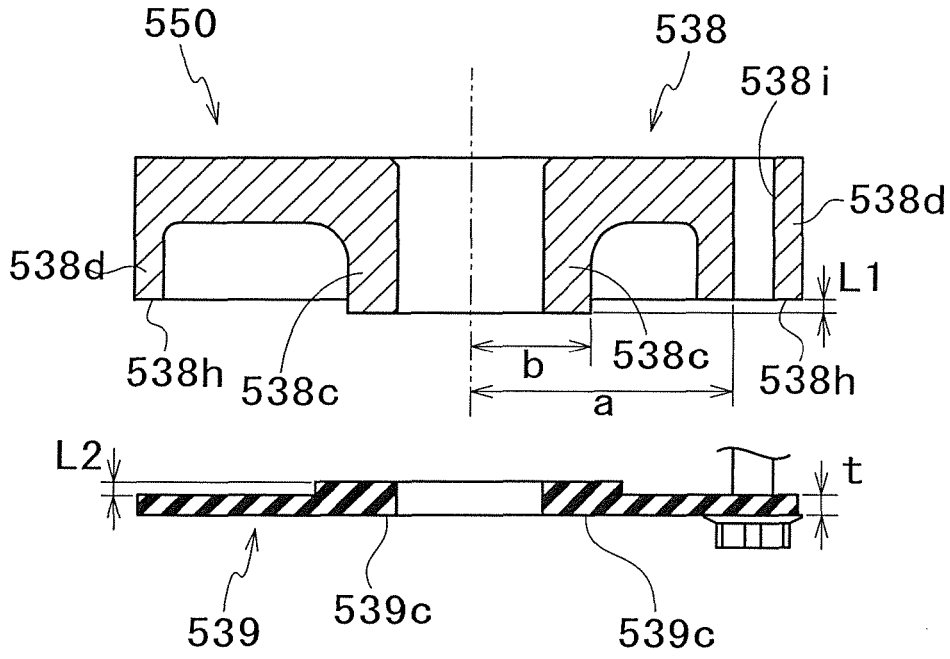
FIG. 13 schematically shows a sealing structure in which the rear head of First Embodiment is combined with the rear muffler of Second Embodiment.
Figure 14:
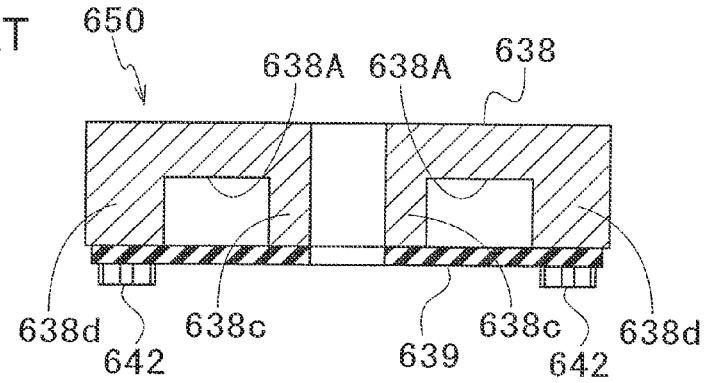
FIG.14 (a) PRIOR ART
FIG. 14 schematically shows a conventional sealing structure between a head component and a muffler component.
Figure 14:
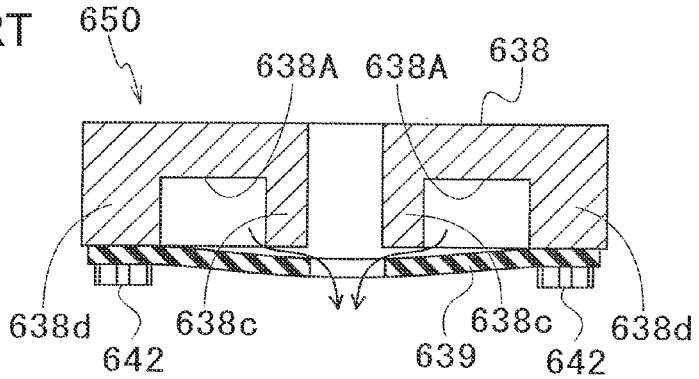
FIG.14 (b) PRIOR ART
Figure 14:
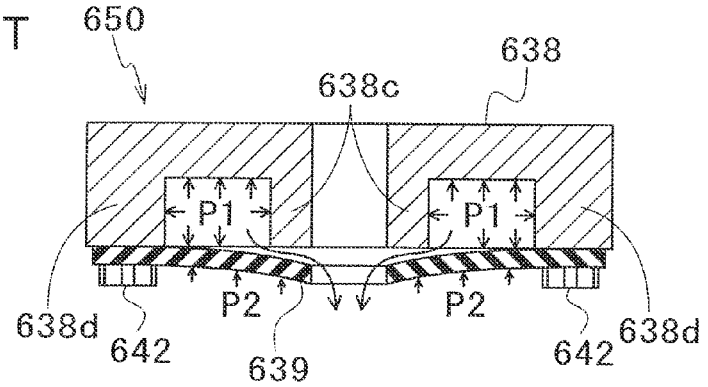
FIG.14 (c) PRIOR ART

First Embodiment above describes the case where the entirety of the end surface 38*g* of the boss portion 38*c* of the rear head 38 is arranged to be further from the main body 38*b* than the plane including the end surface 38*h* of the side wall 38*d*. Second Embodiment above describes the case where the peripheral portion 139*c* of the opening 139*b* of the rear muffler 139 is arranged to protrude from the part contacting the end surface 138*h* of the side wall 138*d*. The present invention is not limited to these arrangements, and may be arranged, as shown in FIG. 13, to be a sealing structure 550 in which the boss portion of the rear head of First Embodiment is combined with the peripheral portion of the rear muffler of Second Embodiment. In this case, a boss portion 538*c* and a side wall 538*d* are preferably arranged so that the value P in the relation (3) below is not higher than 0.02 square millimeters.

$$\text{relation: } P=(t^3\times(L1+L2))/(\alpha\times a^2) \quad (3)$$

where, t: thickness (mm) of rear muffler 539

L1: level difference (mm) between boss portion 538*c* and side wall 538*d* in rear head 538

L2: level difference (mm) between peripheral portion 539*c* of rear muffler 539 and a part of rear muffler 539 which part contacts end surface 538*h* of side wall 538*d* of rear head 538 a: distance (mm) between axial center of rear head 538 and a part of inner periphery of fastening hole 538*i* of side wall 538*d* which part is closest to axial center of rear head 538 b: distance (mm) between axial center of rear head 538 and outer periphery of boss portion 538*c*

α: flexibility factor with respect to diameter ratio b/a

It is noted that the relation (3) also derives from the equation (A) above.

INDUSTRIAL APPLICABILITY

The present invention makes it possible to secure the sealing performance between the head component and the muffler component without precisely processing the mounting surfaces of the head component and the muffler component and without increasing the number of components.

What is claimed is:

1. A sealing structure comprising:

a head component having an ejection port configured and arranged to eject compressed refrigerant, the head component including a main body having a bearing hole configured and arranged to have an axial member inserted therein, an annular boss portion protruding from the main body and circumscribing the bearing hole, and an annular side wall protruding from the main body and circumscribing the boss portion; and a muffler component disposed so that a muffler space is formed between the muffler component and the head component, the muffler component having an opening configured and arranged to have the axial member inserted therein, with a peripheral portion of the opening entirely contacting an end surface of the boss portion, and the muffler component being fastened to an end surface of the annular side wall so that contact between the boss portion and the muffler component causes the muffler component to be warped to protrude away from the main body and remain in contact with the boss portion.

2. The sealing structure according to claim 1, wherein the end surface of the boss portion has a part which is entirely further from the main body than the end surface of the annular side wall.

3. The sealing structure according to claim 2, wherein the end surface of the boss portion is entirely further from the main body than a plane including the end surface of the annular side wall.

4. The sealing structure according to claim 2, wherein the end surface of the boss portion is arranged to taper radially inward.

5. The sealing structure according to claim 2, wherein the muffler component defines a fastening plane before the muffler component is fastened to the head component, and the peripheral portion of the opening is arranged to protrude from a part of the fastening plane contacting the end surface of the annular side wall.

6. The sealing structure according to claim 2, wherein the muffler component is made of a ferrous material, the head component has a plurality of fastening holes penetrating the annular side wall, and the boss portion and the annular side wall are arranged so that a value P is 0.02 square millimeters or lower, with P being calculated from a relation $P=(t^3\times L1)/(\alpha\times a^2)$, where t is a thickness of the muffler component, L1 is a level difference between the boss portion and the annular side wall of the head component, a is a distance between an axial center of the head component and a part of an inner periphery of one of the fastening holes of the annular side wall closest to the axial center of the head component, b is a distance between the axial center of the head component and an outer periphery of the boss portion, and α is a flexibility factor with respect to a diameter ratio b/a.

7. The sealing structure according to claim 2, wherein the head component has an annular bearing portion protruding from the boss portion and circumscribing the bearing hole.

8. The sealing structure according to claim 2, wherein the head component is firmed by sintering.

9. A compressor including the sealing structure according to claim 2.

10. The sealing structure according to claim 1, wherein the muffler component defines a fastening plane before the muffler component is fastened to the head component, with the peripheral portion arranged to protrude from a part of the fastening plane contacting the end surface of the annular side wall.

11. The sealing structure according to claim 10, wherein the peripheral portion is arranged to taper radially inward.

12. The sealing structure according to claim 10, wherein the end surface of the boss portion and the end surface of the annular side wall are on a single plane.

13. The sealing structure according to claim 10, wherein the end surface of the boss portion has a part which is entirely further from the main body than a plane including the end surface of the annular side wall.

14. The sealing structure according to claim 13, wherein the end surface of the boss portion is entirely further from the main body than the plane including the end surface of the annular side wall.

15. The sealing structure according to claim 10, wherein the muffler component is made of a ferrous material, the head component has plural fastening holes penetrating the annular side wall, and the boss portion and the annular side wall are arranged so that a value P is 0.02 square millimeters or lower, with P being calculated from a relation. $P=(t^3\times L2)/(\alpha\times a^2)$, where t is a thickness of the muffler component, L2 is a level difference between a peripheral portion of the muffler component and a part of the muffler component contacting the end surface of the annular side wall of the head component, a is a distance between an axial center of the head component and a part of an inner periphery of one of the fastening holes of the annular side wall closest to the axial center of the head component, b is a distance between the axial center of the head component and an outer periphery of the boss portion, and $\alpha$ is a flexibility factor with respect to a diameter ratio b/a.

16. The sealing structure according to claim 13, wherein the muffler component is made of a ferrous material, the head component has plural fastening holes penetrating the annular side wall, and the boss portion and the annular side wall are arranged so that a value P is 0.02 square millimeters or lower, with P being calculated from a relation $P=(t^3\times(L1+L2)/(\alpha\times a^2)$, where t is a thickness of the muffler component, L1 is a level difference between the boss portion and the annular side wall of the head component, L2 is a level difference a peripheral portion of the muffler component and a part of the muffler component contacting the end surface of the annular side wall of the head component, a is a distance between an axial center of the head component and a part of an inner periphery of one of the fastening holes of the annular side wall closest to the axial center of the head component, b is a distance between the axial center of the head component and an outer periphery of the boss portion, and $\alpha$ is a flexibility factor with respect to a diameter ratio b/a.

17. The sealing structure according to claim 10, wherein the head component is formed by sintering.

18. A compressor including the sealing structure according to claim 10.

19. The sealing structure according to claim 5, wherein the muffler component is made of a ferrous material, the head component has plural fastening holes penetrating the annular side wall, and the boss portion and the annular side wall are arranged so that a value P is 0.02 square millimeters or lower, with P being calculated from a relation $P=(t^3\times(L1+L2))/(\alpha\times a^2)$, where t is a thickness of the muffler component, L1 is a level difference between the boss portion and the annular side wall of the head component, L2 is a level difference between a peripheral portion of the muffler component and a part of the muffler component contacting the end surface of the annular side wall of the head component, a is a distance between an axial center of the head component and a part of an inner periphery of one of the fastening holes of the annular side wall closest to the axial center of the head component, b is a distance between the axial center of the head component and an outer periphery of the boss portion, and $\alpha$ is a flexibility factor with respect to a diameter ratio b/a.

20. The sealing structure according to claim 1 wherein the head component has an annular bearing portion protruding from the boss portion and circumscribing the bearing hole.

* * * * *